US011072519B2

(12) United States Patent
Carnoske

(10) Patent No.: US 11,072,519 B2
(45) Date of Patent: Jul. 27, 2021

(54) METHOD OF PRESERVING WINE IN A WINE BOTTLE

(71) Applicant: Angela Carnoske, Key West, FL (US)

(72) Inventor: Angela Carnoske, Key West, FL (US)

( * ) Notice: Subject to any disclaimer, the term of this patent is extended or adjusted under 35 U.S.C. 154(b) by 40 days.

(21) Appl. No.: 16/179,582

(22) Filed: Nov. 2, 2018

(65) Prior Publication Data

US 2019/0127196 A1 May 2, 2019

Related U.S. Application Data

(60) Provisional application No. 62/580,735, filed on Nov. 2, 2017.

(51) Int. Cl.

| | |
|---|---|
| ***B67B 7/06*** | (2006.01) |
| ***B67B 1/04*** | (2006.01) |
| ***A47G 23/03*** | (2006.01) |
| ***B65D 51/18*** | (2006.01) |
| ***B65D 39/00*** | (2006.01) |

(52) U.S. Cl.

CPC ..... *B67B 7/06* (2013.01); *A47G 23/03* (2013.01); *B65D 39/0011* (2013.01); *B65D 51/18* (2013.01); *B67B 1/045* (2013.01); *B65D 2251/0012* (2013.01); *B65D 2251/0075* (2013.01); *B67B 2201/03* (2013.01)

(58) Field of Classification Search

CPC .. B67B 1/00; B67B 1/04; B67B 1/045; B67B 7/00; B67B 7/02; B67B 7/06; B67B 2201/03; B67B 6/00; B65D 39/00; B65D 39/0011; B65D 39/0023; B65D 39/0029; B65D 39/0052; B65D 39/0058; B65D 39/007; B65D 39/0076; B65D 39/04; B65D 39/16; B65D 51/18; B65D 51/24; B65D 51/249; B65D 55/063; B65D 2251/0012; B65D 2251/0068; B65D 2251/0075; B65D 2539/00; B65D 2539/001; A47G 23/02; A47G 23/0241; A47G 23/03

USPC ..... 53/420, 421, 422, 484, 485, 489, 286; 81/3.4, 3.41; 215/295, 296, 298, 303, 215/305, 355, 363, 364, 354; 248/346.11

See application file for complete search history.

(56) References Cited

U.S. PATENT DOCUMENTS 398,944 A * 3/1889 Crary ..... B65D 55/063 215/291
508,367 A * 11/1893 Butts et al. ..... B65D 39/16 215/296
544,967 A * 8/1895 Day ..... B65D 39/04 215/270

(Continued)

FOREIGN PATENT DOCUMENTS

FR 413910 A * 8/1910 ..... B65D 39/00
FR 435696 A * 3/1912 ..... B65D 39/0011

(Continued)

*Primary Examiner* — Stephen F. Gerrity
(74) *Attorney, Agent, or Firm* — Hall Estill Law Firm

(57) ABSTRACT

The present disclosure is directed to a wine tool for preserving wine in a wine bottle. The wine tool include a body and a grippable portion. The body has an open end, a closed end, and a sidewall extending between the open end and the closed end. The sidewall has an elevated outer peripheral surface and an inner peripheral surface. The grippable portion is positioned about a portion of the body for assisting a user with removal and placement of a cork into a wine bottle.

6 Claims, 4 Drawing Sheets

(56) References Cited

U.S. PATENT DOCUMENTS 703,524 A * 7/1902 Brewington ..... B65D 39/16 215/296
794,478 A * 7/1905 Abbott ..... B65D 39/16 215/364
1,030,948 A * 7/1912 von der Heyden .... B65D 39/04 215/354
2,131,878 A * 10/1938 Lawrence ..... A47G 23/03 215/394
2,705,573 A * 4/1955 Zepelovitch ..... B65D 39/007 215/361
2,723,041 A * 11/1955 Hart-Still ..... B65D 39/04 215/270
2,792,583 A * 5/1957 Alfano ..... A47L 13/022 15/229.13
2,835,092 A * 5/1958 Schneider ..... B67B 1/04 53/321
2,886,220 A * 5/1959 Mangravite ..... B65D 39/0058 222/545
3,733,041 A * 5/1973 Clavera ..... A47F 7/285 248/154
4,001,904 A * 1/1977 Gill ..... B67B 7/18 7/151
4,726,264 A * 2/1988 Bost ..... B67B 7/02 81/3.09
4,766,781 A * 8/1988 Grise et al. ..... B67B 7/18 81/3.4
5,000,062 A * 3/1991 Bergmeister ..... B67B 7/066 81/3.4
D319,957 S * 9/1991 Bergmeister ..... A47L 13/022 D8/40
6,786,062 B1 * 9/2004 Greenberg ..... F25D 3/08 62/457.4
2012/0305598 A1 * 12/2012 Costello ..... A47G 23/0241 222/185.1
2014/0166672 A1 * 6/2014 Stroucken ..... B67B 7/00 220/592.01
2017/0073126 A1 * 3/2017 Comer ..... B65D 51/18

FOREIGN PATENT DOCUMENTS

FR 1049694 A * 12/1953 ..... B65D 39/0011
FR 1578112 A * 8/1969 ..... B65D 39/04
GB 424544 A * 2/1935 ..... A47G 23/0241

* cited by examiner

METHOD OF PRESERVING WINE IN A WINE BOTTLE

CROSS-REFERENCE TO RELATED APPLICATIONS

This application claims benefit under 35 U.S.C. 119(e) of U.S. Provisional Application Ser. No. 62/580,735, filed Nov. 2, 2017, which is hereby expressly incorporated herein by reference in its entirety.

FIELD OF THE INVENTION

The present disclosure relates generally to wine tools, and more particularly, not by way of limitation, to a wine tool for preserving the wine after opening the bottle and removing the reinserted cork.

BACKGROUND OF THE INVENTION

While various devices and methods are available to help in preserving wine in a bottle after the bottle is open, such as cork stoppers, reinsertion of original corks, screw caps, coravins, many are expensive and/or continually fail due to varying bottle sizes. To this end, an improvement and/or need exists for keeping oxygen away from the wine in order to extend the life of the remaining wine in a bottle. It is to such a wine tool that the present disclosure is directed.

BRIEF DESCRIPTION OF THE DRAWING(S)

DETAILED DESCRIPTION OF THE INVENTION

Figure 1:
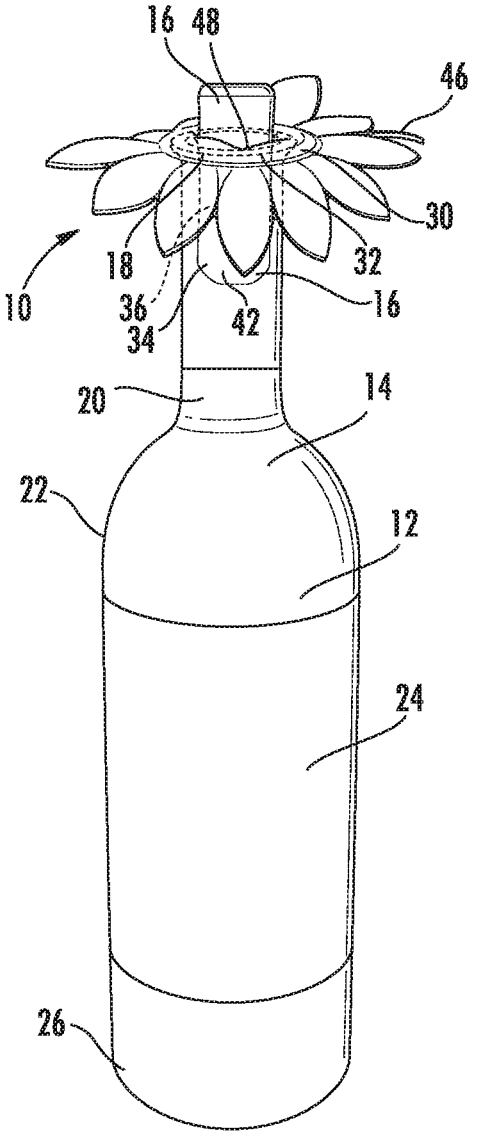
FIG. 1 is a perspective view of one embodiment of a wine tool constructed in accordance with the present disclosure, the wine tool being positioned in and about a top of a wine bottle.
Figure 2:
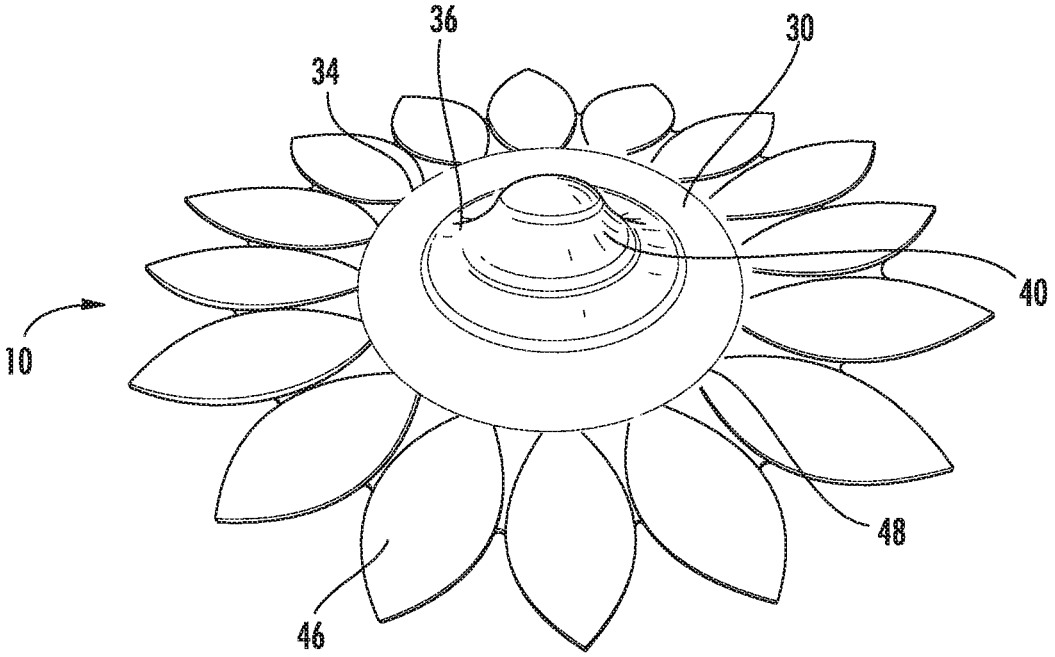
FIG. 2 is a top view of the wine tool of FIG. 1.
Figure 3:
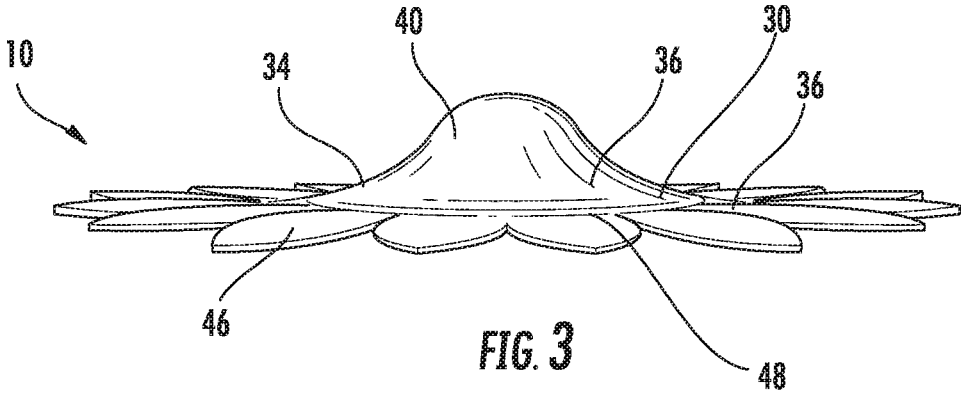
FIG. 3 is a side view of the wine tool of FIG. 1.
Figure 4:
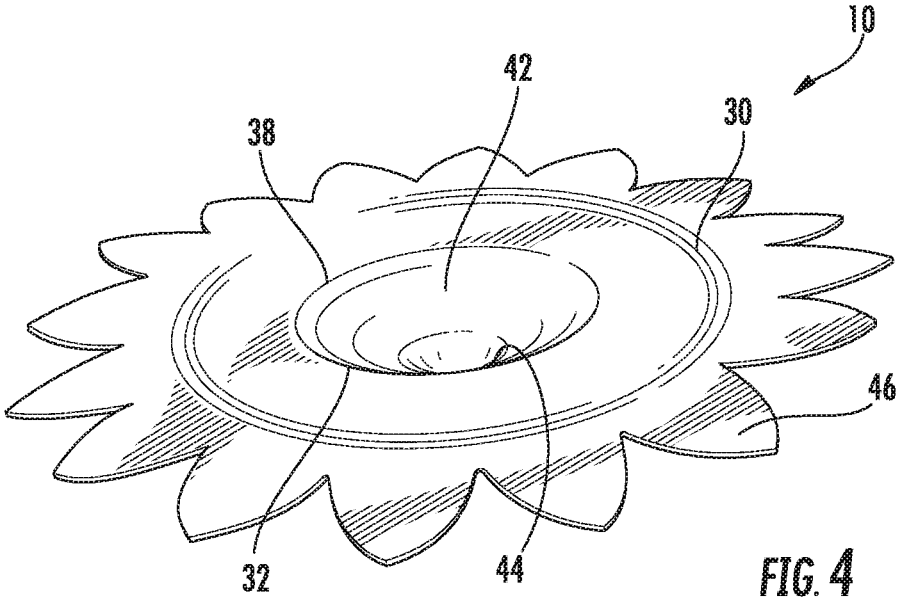
FIG. 4 is an elevational view of the bottom of the wine tool of FIG. 1.
Figure 5:
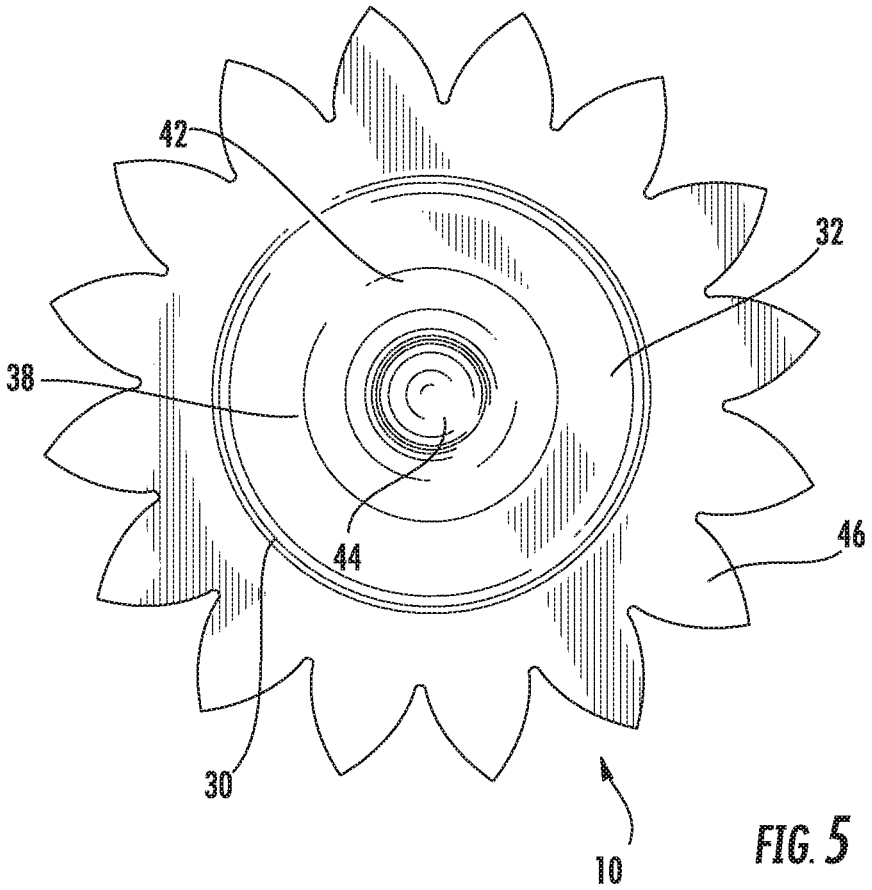
FIG. 5 is a top view of the bottom of the wine tool of FIG. 1.

Before explaining at least one embodiment of the inventive concept disclosed herein in detail, it is to be understood that the inventive concept is not limited in its application to the details of construction, experiments, exemplary data, and/or the arrangement of the components set forth in the following description, or illustrated in the drawings. The presently disclosed and claimed inventive concept is capable of other embodiments or of being practiced or carried out in various ways. Also, it is to be understood that the phraseology and terminology employed herein is for purpose of description only and should not be regarded as limiting in any way.

In the following detailed description of embodiments of the inventive concept, numerous specific details are set forth in order to provide a more thorough understanding of the inventive concept. However, it will be apparent to one of ordinary skill in the art that the inventive concept within the disclosure may be practiced without these specific details. In other instances, well-known features have not been described in detail to avoid unnecessarily complicating the instant disclosure.

Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Referring now to the drawings, and more particularly to FIG. 1, shown therein is one embodiment of a wine tool 10 constructed in accordance with the inventive concepts disclosed herein, the wine tool 10 being shown positioned about a wine bottle 12. The wine bottle 12 is a typical wine bottle used for holding wine and is well known to one of ordinary skill in the art. The wine bottle 12 includes an outer surface 14, a cork 16 positioned in an opening (finish) 18 of the bottle 12 for sealing the wine in the bottle 12, a neck 20, a shoulder 22, a body 24 and a heel 26. Other methods for sealing a bottle are known by one of ordinary skill in the art. Thus, no further discussion is believed necessary regarding the wine bottle or its operation.

Referring to FIGS. 1-6, it is contemplated, in one embodiment, that the wine tool 10 is constructed from a single component, however, it should be understood by one of ordinary skill in the art that the wine tool 10 may be constructed from multiple pieces of materials such that one portion is constructed from an elastomeric material and a second portion is constructed from a non-elastomeric material. The wine tool 10 is preferably made of elastomeric materials, such as neoprene, rubber, latex or other such elastomeric polymer which enables the wine tool 10 to return to its original shape once removed from the wine bottle 12. However, the materials are strong enough to allow for use of the wine tool 10, as disclosed herein. The wine tool 10 may be constructed from a variety of durable and resilient materials, such as for example, polymeric materials, plastics, thermoplastics, any elastomers, and composite materials which are capable of providing the desired strength and durability for the wine tool 10. The wine tool 10 may be constructed from a material impregnated with an elastic material in a portion of the wine tool 10 to form an elastomeric portion. Further, it should be understood that the wine tool 10 may be constructed from materials that may be absorbent, food safe, water-resistant and/or waterproof so that the wine tool 10 may be easily cleaned.

The wine tool 10 is shown as substantially circular in shape. However, it should be understood that the wine tool 10 or portions thereof may be any shape, such as conical, oval, square, rectangular, triangular, polygonal, spherical, quadrilateral, ellipsoidal and the like, for example. The wine tool 10 may be rigid, semi-rigid, flexible, semi-flexible, foldable, collapsible, and the like. It should be understood that the size and configuration of the wine tool 10, and portions thereof, may vary widely dependent upon the size of the wine bottle 12.

The wine tool 10 has a body 30 which includes an open first end 32, a closed second end 34, and a sidewall 36 extending between the open end 32 and the closed end 34. An inner rim 38 is provided about the open end 32 to help secure the wine tool 10 to the wine bottle 12 and provide a connection between the wine tool 10 and the wine bottle 12. The closed end 34 is shown herein as being rounded and/or spherical in shape. It will be appreciated, however, that the closed end 34 of the wine tool 10 may be configured in and comprise variations of any shapes or may comprise significantly altered shapes such as square or rectangular, as long as the wine tool 10 functions in accordance with the present invention in the manner described herein. The sidewall 36 has an elevated outer peripheral surface 40 and an inner peripheral surface 42 which encompasses an inner space 44 so as, in some embodiments, to receive the cork 16 being reinserted into the wine bottle 12. The wine tool 10 is provided with a grippable and/or graspable portion 46 positioned about an edge 48 of the outer peripheral surface 40 to assist in removal of the cork 16. The grippable portion 46 may be configured in various ways, such as with decorative flower petals shown herein by way of example, so long as the grippable portion 46 functions to assist with the cork 16 removal from the wine bottle 12 and the recorking process, as described herein.

In use, when storing or not using the wine bottle 12, the inner peripheral surface 42 of the wine tool 10 is positioned on the opening 18 of the bottle 12. The cork 16 is pressed against the elevated outer peripheral surface 40 so as to push the elevated outer peripheral surface 40 into the bottle 12. The elevated outer peripheral surface 40 is inverted by the cork 16 and pushed into a portion of the neck 20 of the bottle 12 so that an inverted outer peripheral surface 40 receives the cork 16 and a relatively airtight seal is created between the cork 16, the inner peripheral surface 42 of the wine tool 10 and an inner peripheral surface of the wine bottle 12 so as to keep oxygen away from the wine so that the life of the wine remaining in the wine bottle is extended.

In another embodiment of use, the open end 32 of the wine tool 10 is stretched and positioned about the first end 22 of the wine bottle 12 to engage a portion of the outer surface 14 of the wine bottle 12 about the opening 18 of the wine bottle 12. A relatively airtight seal is created between the outer surface 14 of the wine bottle 12 and the inner peripheral surface 42 of the wine tool 10 so as to keep oxygen away from the wine so that the life of the wine remaining in the wine bottle is extended.

Figure 6:
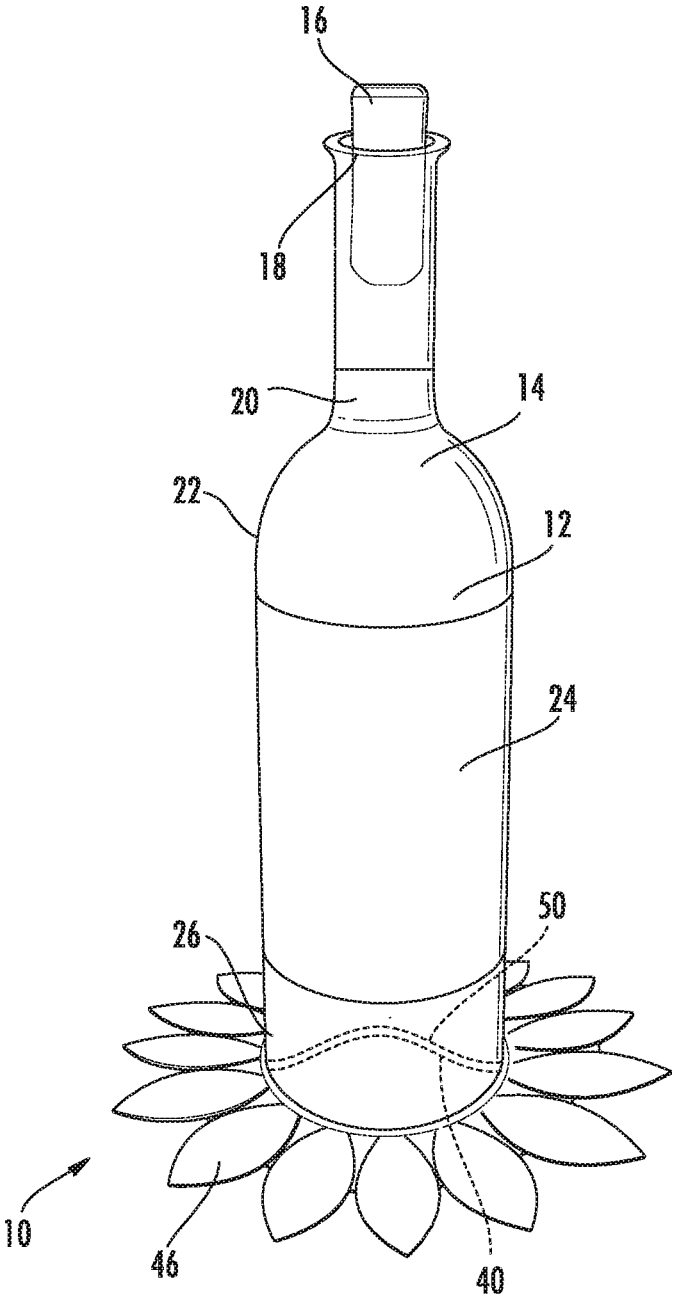
FIG. 6 is a perspective view of a wine bottle positioned on the wine tool of FIG. 1.

Referring to FIG. 6, the wine tool 10 may also be utilized as a coaster for the wine bottle 12 on hard surfaces or any other of various surfaces. The wine tool 10 is positioned on a surface with the outer peripheral surface 40 in an upright position. The wine bottle 12 is set on top of the wine tool 10 such that the punt 50 of the wine bottle 12 is positioned to receive the elevated outer peripheral surface 40 of the wine tool 10.

From the above description, it is clear that the inventive concept(s) disclosed herein is well adapted to carry out the objects and to attain the advantages mentioned herein as well as those inherent in the inventive concept disclosed herein. While exemplary embodiments of the inventive concept disclosed herein have been described for purposes of this disclosure, it will be understood that numerous changes may be made which will readily suggest themselves to those skilled in the art and which are accomplished without departing from the scope of the inventive concept disclosed herein and defined by the appended claims.

What is claimed is:

1. A method for preserving wine in a wine bottle, comprising:

providing a body having an open end, a closed end, and a sidewall extending between the open end and the closed end, the sidewall having an elevated outer peripheral surface and an inner peripheral surface;

positioning the open end of the body about an opening of a wine bottle;

pressing a cork of the wine bottle against the elevated outer peripheral surface of the body; and moving the cork in a downward direction into the neck of the bottle such that the elevated outer peripheral surface is inverted to receive the cork and the inner peripheral surface contacts an inner peripheral surface of the wine bottle so that a relatively airtight seal is created.

2. The method of claim 1 wherein the elevated outer peripheral surface is positioned at the closed end of the body.

3. The method of claim 1 wherein a portion of the body is an elastomeric material.

4. The method of claim 1 wherein a grippable portion is positioned about a portion of the body for assisting a user with removal and placement of the cork into the wine bottle.

5. The method of claim 4 wherein the grippable portion is positioned about an edge of the elevated outer peripheral surface of the sidewall of the body.

6. The method of claim 4 further comprising the step of:

grasping the grippable portion of the body; and moving the grippable portion in an upward direction to assist in removing the cork and body from the wine bottle.

* * * * *